US009648973B2

(12) United States Patent
Maneri

(10) Patent No.: US 9,648,973 B2
(45) Date of Patent: May 16, 2017

(54) CHRISTMAS TREE STAND WITH FLOAT SYSTEM, LOW WATER INDICATOR, AND INDEPENDENT SPRING COMPRESSION SYSTEM

(71) Applicant: Geoffrey Stephen Maneri, Hopewell Junction, NY (US)

(72) Inventor: Geoffrey Stephen Maneri, Hopewell Junction, NY (US)

( * ) Notice: Subject to any disclaimer, the term of this patent is extended or adjusted under 35 U.S.C. 154(b) by 198 days.

(21) Appl. No.: 14/599,868

(22) Filed: Jan. 19, 2015

(65) Prior Publication Data

US 2015/0201783 A1 Jul. 23, 2015

Related U.S. Application Data

(60) Provisional application No. 61/929,751, filed on Jan. 21, 2014.

(51) Int. Cl.
*A47G 33/12* (2006.01)

(52) U.S. Cl.
CPC ..... *A47G 33/1206* (2013.01); *A47G 33/12* (2013.01); *A47G 2033/1286* (2013.01); *A47G 2033/1293* (2013.01)

(58) Field of Classification Search
CPC ..... A47G 33/12; A47G 2033/1286; A47G 2033/1293; A01G 27/003
USPC ..... 47/40.5, 42, 79
See application file for complete search history.

(56) References Cited

U.S. PATENT DOCUMENTS 3,582,028 A * 6/1971 Purdy ..... A47G 33/12 248/519
4,373,155 A * 2/1983 Dola ..... H01H 35/186 200/84 R
4,989,820 A * 2/1991 Sterling ..... A47G 33/12 248/523
5,473,837 A * 12/1995 Skoczylas ..... A01G 27/003 47/40.5
5,522,179 A * 6/1996 Hollis ..... A01G 27/003 137/451
5,575,110 A * 11/1996 Couture ..... A01G 27/003 47/40.5
5,937,574 A * 8/1999 Jacques ..... A01G 27/005 137/414
6,073,390 A * 6/2000 Baudier ..... A47G 33/12 47/40.5

(Continued)

*Primary Examiner* — David Parsley
(74) *Attorney, Agent, or Firm* — Aziz M. Ahsan; Ahsan & Associates, PLLC

(57) ABSTRACT

The present invention generally relates to a live plant or tree, such as, a Christmas tree that is being held in water, inside a stand, and also has a low water indicator. The present invention also provides a Christmas tree stand that has a low water indicator, and has an independent spring compression system that is self-adjusting and serves to position the tree securely and up-right. The low water indicator system is a float device that will rise and fall with the water level, mainly including a float, plunger, activation wire, power source, and buzzer that is built or attached to the tree stand. As the water level drops the float-plunger system activates an electrical connection and causes an alarm to be activated. Upon the activation of the alarm the tree stand will require water, and once water is added, the alarm will automatically deactivate.

20 Claims, 7 Drawing Sheets

(56) References Cited

U.S. PATENT DOCUMENTS

| | | | | |
|---|---|---|---|---|
| 6,572,069 | B1 * | 6/2003 | Kotthaus | A47G 33/12 248/521 |
| 7,886,483 | B2 * | 2/2011 | Solak | A01G 27/008 47/40.5 |
| 8,132,360 | B2 | 3/2012 | Jin et al. | |
| 2001/0000836 | A1 * | 5/2001 | Scannell, Jr. | A01G 27/008 47/40.5 |
| 2004/0065007 | A1 * | 4/2004 | Manell | A47G 33/12 47/40.5 |
| 2014/0259903 | A1 * | 9/2014 | Earliwine | G08B 21/182 47/40.5 |

* cited by examiner

CHRISTMAS TREE STAND WITH FLOAT SYSTEM, LOW WATER INDICATOR, AND INDEPENDENT SPRING COMPRESSION SYSTEM

CROSS-REFERENCE TO RELATED APPLICATION

The instant patent application claims priority to and the benefit of U.S. Provisional Patent Application Ser. No. 61/929,751, filed on Jan. 21, 2014, titled "Christmas Tree Stand With Float System & Low Water Indicator," the entire disclosure of which provisional application is incorporated herein by reference.

FIELD OF THE INVENTION

The present invention relates generally to a Christmas tree stand with a float system, and a low water indicator apparatus and a method of using same. More particularly, the invention encompasses a Christmas tree stand with a float system, a low water indicator, and an independent spring compression system, and a method of using the same. The present invention also provides a Christmas tree stand that has a low water indicator and has an independent spring compression system that is self-adjusting and serves to position the tree securely and up-right. The low water indicator system is a float device that will rise and fall with the water level, due to a float. A plunger, activation wire, power source, and an alarm or buzzer is built or attached to the tree stand. As the water level drops to, let say, 1 quart, the float-plunger system activates a wire, making a connection with an electrically conductive metal washer, and cause a buzzer or alarm to go ON. At that time the tree stand will require water, once water is added, the buzzer will go OFF, as the float rises due to the addition of water to the water reservoir. The present invention also generally relates to a plant, such as, a Christmas tree, and more specifically relates to a support within the tree stand that will hold the tree in place, and have a low water indicator.

BACKGROUND INFORMATION

It has been a challenge to place a Christmas tree into the stand with a simplified system, and to keep the Christmas trees alive, from a period starting before Christmas, and often ending well after New Year's Day.

U.S. Pat. No. 8,132,360 (Samuel Zhihui Jin, et al.), the entire disclosure of which is incorporated herein by reference, discloses a Christmas tree stand that is self-watering and rotatable. The self-watering system, that rotates with the tree, mainly includes a water reservoir, a hose, a water tank that holds on to the lower end of the tree, and a valve mechanism that automatically keeps the water in the water tank at optimum level. A rotatable tank assembly is driven by an electric drive motor on a stationary support assembly. Electrical power is passed from the stationary support assembly to the rotatable tank assembly through a slipping-ring connector. In the preferred embodiment, a remote control is provided to supply power for rotation of the rotatable tank assembly, including the tree, and the power receptacle on the rotatable tank assembly for suitable electrical loads, e.g., decorative lights, separately.

This invention improves on the deficiencies of the prior art and provides an inventive Christmas tree stand with a float system, a low water indicator, and an independent spring compression system, and a method of using the same.

PURPOSES AND SUMMARY OF THE INVENTION

The invention is a novel Christmas tree stand with a float system, a low water indicator, and an independent spring compression system, and a method of using the same.

Therefore, one purpose of this invention is to provide a Christmas tree stand with a float system, having a low water indicator.

Another purpose of this invention is to provide a Christmas tree stand with an independent spring compression system, that will stabilize and keep the Christmas tree erect when inside the inventive Christmas tree stand.

Yet another purpose of this invention is to provide a low cost solution for maintaining and extending the life of a Christmas tree when the Christmas tree is cut from its roots and placed in an indoor type environment.

Therefore, in one aspect this invention comprises a tree stand comprising:

(a) a stand having a base and a neck, said neck having at least one opening for passage of a trunk of a tree;

(b) at least one water reservoir contained within said stand, and wherein said water reservoir is between said base and said neck of said stand;

(c) at least one tube secured and interconnected with said water reservoir, and wherein said at least one tube has a plunger which move vertically within said at least one tube, and wherein water freely moves between said at least one tube and said at least one water reservoir;

(d) said plunger having a shaft, and wherein an activation disc is secured to an upper end of said shaft, and at least one float is secured to a lower end of said shaft, and wherein said float is in physical contact with said water in said tube, and wherein said plunger moves vertically within said at least one tube as a result of water movement within said at least one water reservoir and said at least one tube; and (e) wherein said stand has at least one electrical bridge, at least one activation contact, at least one power source contact, and at least one power source therein, and wherein said activation disc activates an alarm when said water level is below a first threshold, and wherein said alarm is activated when said activation disc comes in contact with said at least one electrical bridge, said at least one activation contact, and said at least one power source contact.

In another aspect this invention comprises a tree stand comprising:

(a) a stand having a base and a neck, said neck having at least one opening for passage of a trunk of a tree;

(b) at least one water reservoir contained within said stand, and wherein said water reservoir is between said base and said neck of said stand;

(c) at least one tube secured and interconnected with said water reservoir, and wherein said at least one tube has a plunger which move vertically within said at least one tube, and wherein water freely moves between said at least one tube and said at least one water reservoir;

(d) said plunger having a shaft, and wherein an activation disc is secured to an upper end of said shaft, and at least one float is secured to a lower end of said shaft, and wherein said float is in physical contact with said water in said tube, and wherein said plunger moves vertically within said at least one tube as a result of water movement within said at least one water reservoir and said at least one tube;

(e) wherein said stand has at least one electrical bridge, at least one activation contact, at least one power source contact, and at least one power source therein, and wherein said activation disc activates an alarm when said water level is below a first threshold, and wherein said alarm is activated when said activation disc comes in contact with said at least one electrical bridge, said at least one activation contact, and said at least one power source contact; and (f) at least one tree stand spring compression stabilization system contained within said stand, and wherein said at least one tree stand spring compression stabilization system comprises of a metallic band, and a plurality of spring steel, and wherein an upper end of said spring steel is secured to said peripheral wall of said metallic band, and wherein the outer peripheral wall of said metallic band is secured to the inside peripheral wall of said neck of said stand.

DETAILED DESCRIPTION

Figure 1:
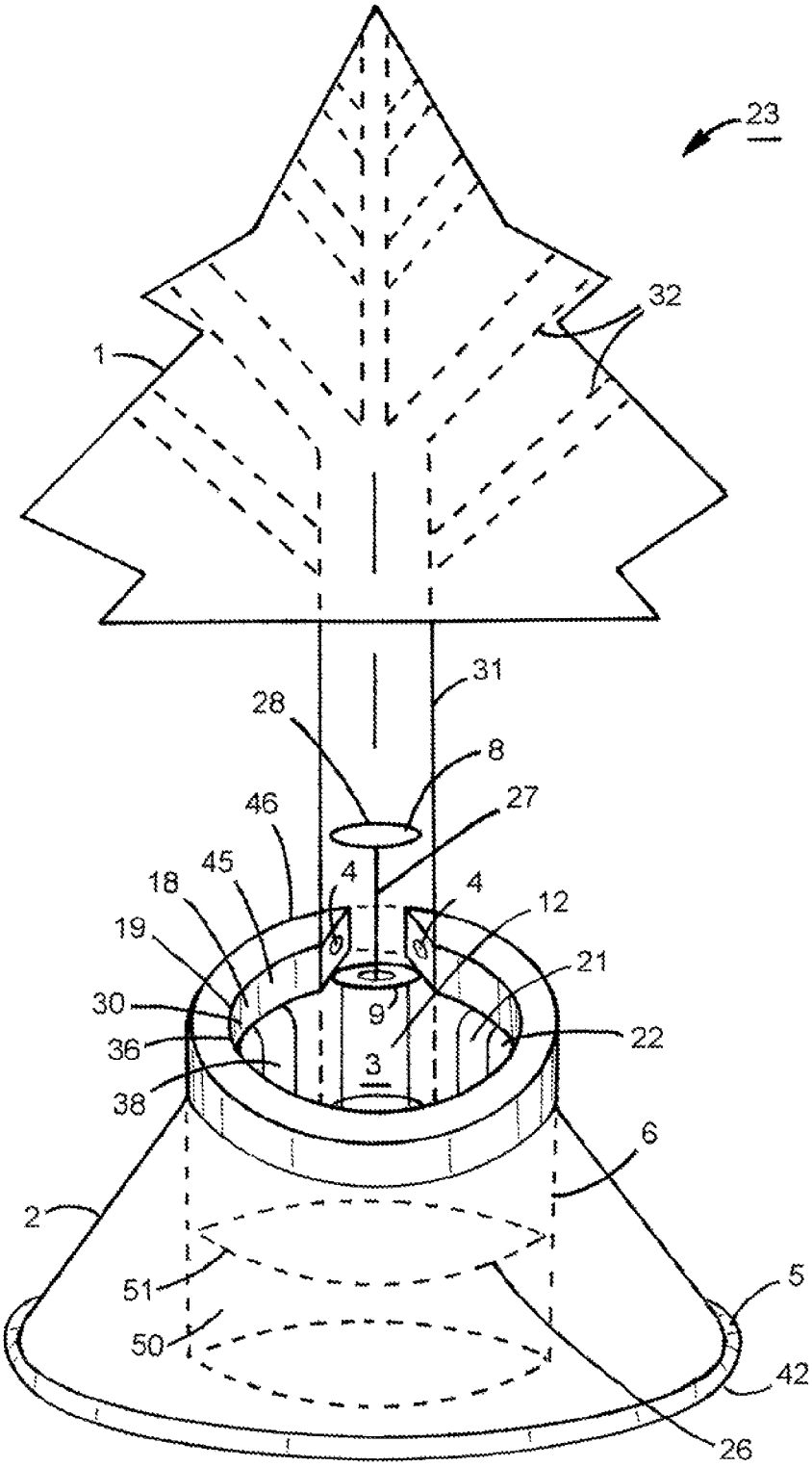
FIG. 1, illustrates a side perspective view of an inventive Christmas tree with stand apparatus, according to one embodiment of this invention.

The inventive Christmas tree stand with a float system, a low water indicator, and an independent spring compression system 23, and a method of using the same, will now be discussed with reference to FIGS. 1 through 8B. Although the scope of the present invention is much broader than any particular embodiment, a detailed description of the preferred embodiment follows together with drawings. These drawings are for illustration purposes only and are not drawn to scale. Like numbers represent like features and components in the drawings. For the ease of understanding not all features of the invention are shown in each drawing.

With the inventive design through self-adjusting spring system placement of the tree is quick and easy. The tree is pushed into the tree stand and the tree will stay where placed, and with this invention there is no more need of getting on the floor to screw the tree into the stand. Any adjustments that are needed are simply accomplished by positioning the tree straight and letting go, and not by adjusting the screws. For most applications the inventive tree stand spring compression stabilization system will hold between about a 2½ inch to about a 5 inch diameter tree trunk (average size) and up to about 8 feet tall tree. The low water indicator system activates a buzzer to inform the user or owner that water is needed for the tree in the stand, and which will assist in a longer life for the tree. This inventive design improves on the existing products by informing the user or owner exactly when the tree needs to be watered, and again there is no longer a need for any screw adjustment system. With this invention there is no more guessing on how much water to add, no overfill, and the tree placed within the inventive tree stand will never go dry.

The invention further comprises of a Christmas tree stand with a float system, and a low water indicator means. The inventive stand, depending on the size, can hold up to, for example, about 3 quarts of water, or with about 2 quarts of water with the tree or plant inside the inventive stand or planter. At least one low water indicator, or a buzzer, or an alarm, or a light, will automatically get activated when the water is low, such as, for example, when about 1 quart of water is needed, or when for example, the water reservoir is down to say 1 quart of water. With this invention the Christmas or plant tree stand will not run dry. This invention greatly improve the functionality of a Christmas tree stand by having a low water indicator, thus preventing the dryness of a Christmas tree, which can also be a cause or source of fire, especially, when a Christmas tree is adorned with Christmas lights.

In operation typically a Christmas tree is preferably placed in the center of the planter or stand, and is then pushed down into the planter or the tree stand. The tree should be stabilized using the automatic adjustment means of the spring compression stabilization system. To adjust the lean (if needed) one would move or rotate the tree or the plant to where it is preferably straight or erect, and the tree or the plant will be secured to stay where placed. This inventive Christmas tree stand can hold trees or plants up to about 8 feet high, and from about 2½ inch to about 5 inches in diameter (average size). It should be understood that for a larger diameter tree one would need an enlarged or bigger version of this inventive apparatus, and similarly for a smaller diameter tree one would need a smaller version of this inventive apparatus.

Figure 8A:
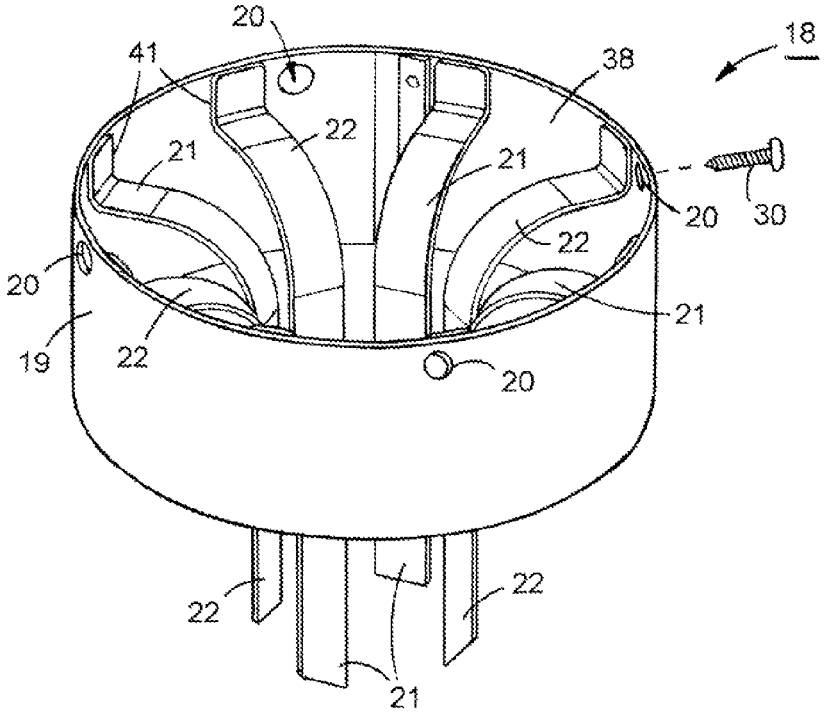
FIG. 8A, illustrates a perspective view of an inventive tree stand spring compression stabilization system, according to one embodiment of this invention.
Figure 8B:
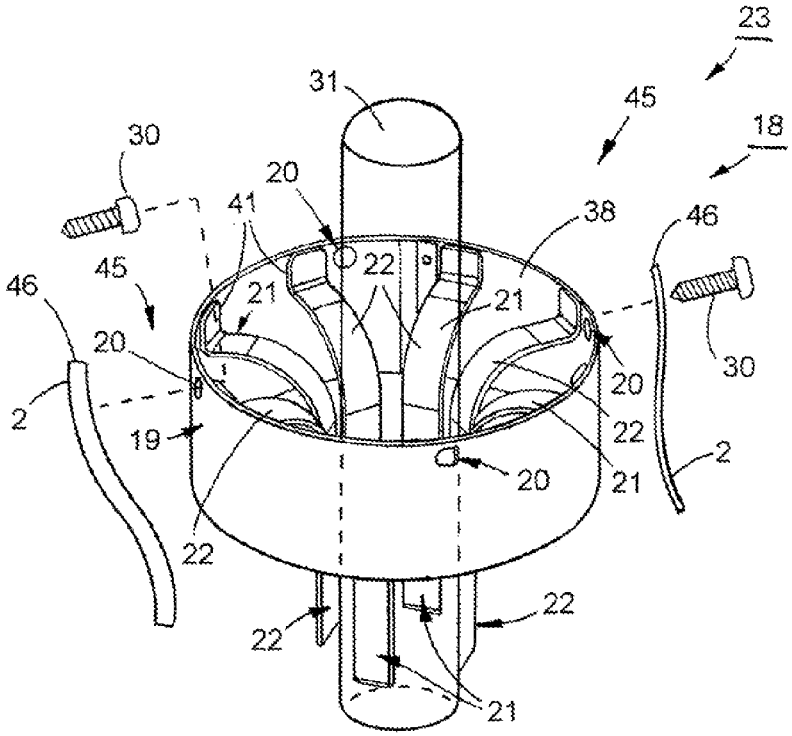
FIG. 8B, illustrates a perspective view of an inventive tree stand spring compression stabilization system showing a tree in an erect and stabilized mode, according to one embodiment of this invention.

Now referring to FIG. 1, through FIG. 8B, which illustrate various views of the inventive Christmas tree stand with a float system, a low water indicator, and an independent spring compression system 23, where a Christmas tree 1, is held upright inside a stand 2, which further comprises a water reservoir 6, having a water level 26. The Christmas tree 1, is supported by an inventive spring compression stabilization system 18, which serves to position the Christmas tree 1, securely and upright into the water reservoir 6, inside of the stand 2, which also contains an inventive low water indication float device system 3, which is preferably encased in a cylinder or a tube 12. The spring compression stabilization system 18, is designed to substantially match a typical Christmas tree trunk 31, so as to cause it to be aligned with the axis of the tree trunk 31. The spring compression expansion system 18, allows for an opening 38, that can expand to accommodate various diameter Christmas tree trunks 31, while maintaining grip and stability through multiple points of contacts 21, 22, with the Christmas tree trunk 31. This expansion of the grip can be accomplished in a number of ways, such as, for example, providing a plurality of spring steel pieces 21, 22, that can expand to accommodate the diameter and a trunk portion 31, of the Christmas tree 1. The formed spring steel pieces 21, 22, are preferably securely attached to a metallic ring 19. The metallic ring 19, is mounted to the inside of the stand 2, via at least one securing means 30, such as, using screws 30, through the mounting screw holes 20. The low water float indicator system 3, which is encased in the tube 12, is attached to the stand 2, which contains a plunger 8, that rises and falls with the water level 26, through a float 7, that is attached to the plunger 8. The low water float indicator system 3, is activated when the water level 26, is low, for example, when the water level 26, is down to say one quart of water 50, remaining in the water reservoir 6. The plunger 8, having the float 7, will automatically get lowered when the water level 26, is low, thus pushing an activation wire 10, onto an electrical connection 9, such as, for example, a metal washer 9, which would then trigger a power source wire 11, which is connected to a power source 16, such as, a battery pack 16, thus completing the circuit, and setting off the buzzer or alarm 17, which is mounted to the stand 2.

FIG. 1, illustrates a side perspective view of an inventive Christmas Tree with stand apparatus 23, according to one embodiment of this invention. As shown in FIG. 1, the Christmas tree 1, having a trunk 31, and branches 32, is held upright in a tank assembly stand 2, and where the Christmas tree 1, is supported by the inventive spring compression stabilization system 18, and where the inventive floatation device system 3, provides the water 50, monitoring for the Christmas tree 1. The tank assembly stand 2, has a stand base 42, and a stand neck or mouth 46, having an opening 45. The water reservoir 6, has a water level 26, and where the water level 26, is continuously, and automatically monitored by the inventive floatation device system 3, for the replenishment of the water 50. Preferably, the stand 2, has an overfill or catch channel 5.

Figure 2:
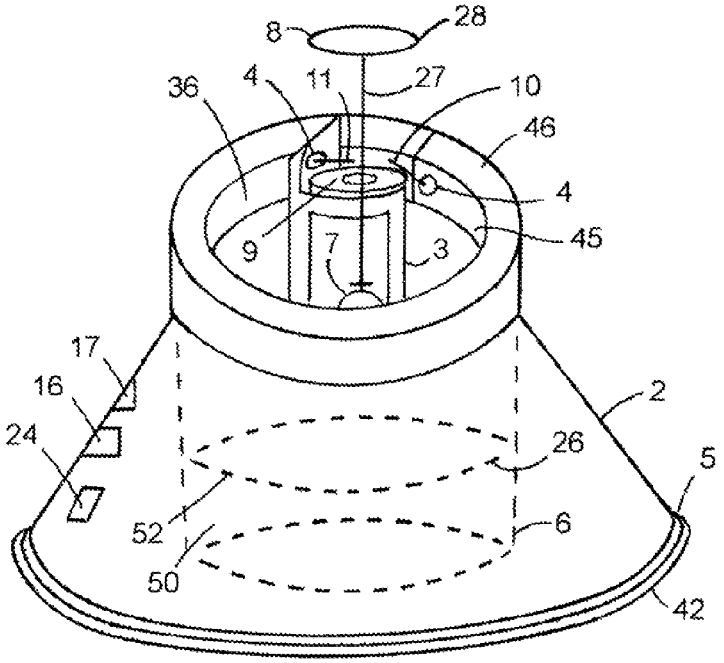
FIG. 2, illustrates a side perspective view of an inventive stand with an inventive floatation device system, according to an embodiment of this invention.

FIG. 2, illustrates a side perspective view of an inventive stand 2, with an inventive floatation device system 3, according to an embodiment of this invention. FIG. 2, is also a close up view of the floatation device system 3, mounted into the stand 2, showing holes or openings for wiring access 4, along with the overfill or catch channel 5, and the plunger system 8. The plunger system 8, comprises of a plunger rod or shaft 27, with an activation disc or tab 28, at the upper end, and a float 7, at the opposite or lower end. The float 7, is preferably allowed to freely move along the plunger shaft 27, between the upper float stop 14A, and the lower float stop 14B, as more clearly seen in FIG. 4. Within the stand 2, one could have a battery pack 16, an alarm or buzzer 17, and an ON/OFF switch 24. It should be appreciated that the over fill channel 5, is to catch any water 50, that may overflow when the water 50, is poured inside the stand 2, via the water reservoir mouth or opening 36, into the water reservoir 6, and the tube 12.

Figure 3:
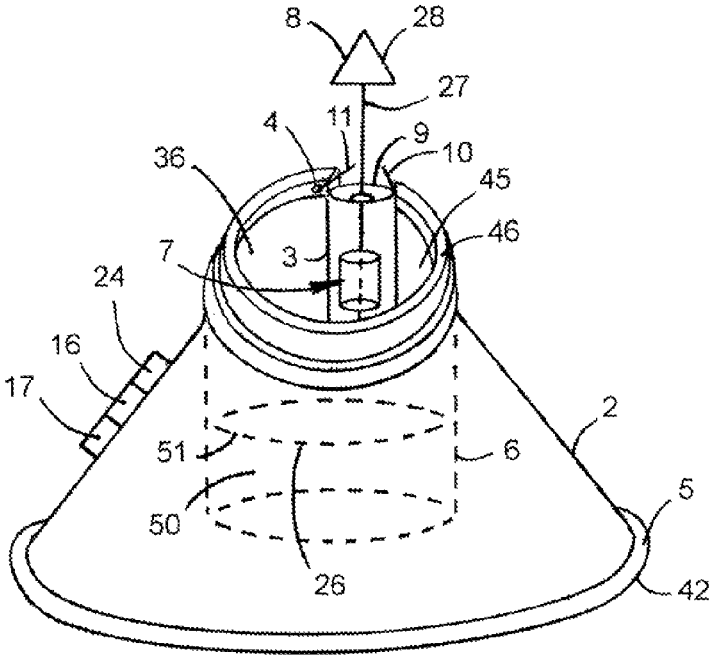
FIG. 3, illustrates a detailed enlarged view of an inventive stand with an inventive floatation device system, according to another embodiment of this invention.

FIG. 3, illustrates a detailed enlarged view of an inventive stand 2, with an inventive floatation device system 3, according to another embodiment of this invention. FIG. 3, shows the inside view of the water reservoir 6, which is located inside the stand 2. The float 7, raises and lowers the plunger 8, due to the fluctuation of the water level 26, inside the water reservoir 6. The electrically conductive component 9, such as, an electrically conductive metal washer 9, is used to activate the alarm or buzzer 17, as more clearly seen in FIG. 6. This is done due to the fact that as the water 50, in the water reservoir 6, either evaporates or is consumed by the Christmas tree 1, the water level 26, gets lower, and this also lowers the float 7, to go low, which then drags the plunger system 8, to go low, and then at a predictable or set point the activation disc or tab 28, pushes the activation wire 10, to come in contact with the electrically conductive component 9, which has a connection with a power source wire 11, thus completing the circuit between the activation wire 10, and the power source wire 11, and which then activates the buzzer or alarm 17, to be activated. However, once the water 50, is poured or replenished into the water reservoir 6, the float 7, rises along with the water level 26, and the activation disc or tab 28, is then also separated from the activation wire 10, and the electrically conductive component 9, as the activation disc or tab 28, also rises with the water level 26, thus deactivating the circuit, and also the alarm or buzzer 17. Optionally, one could also have an ON/OFF switch 24, to either activate or deactivate the alarm or buzzer 17.

Figure 4:
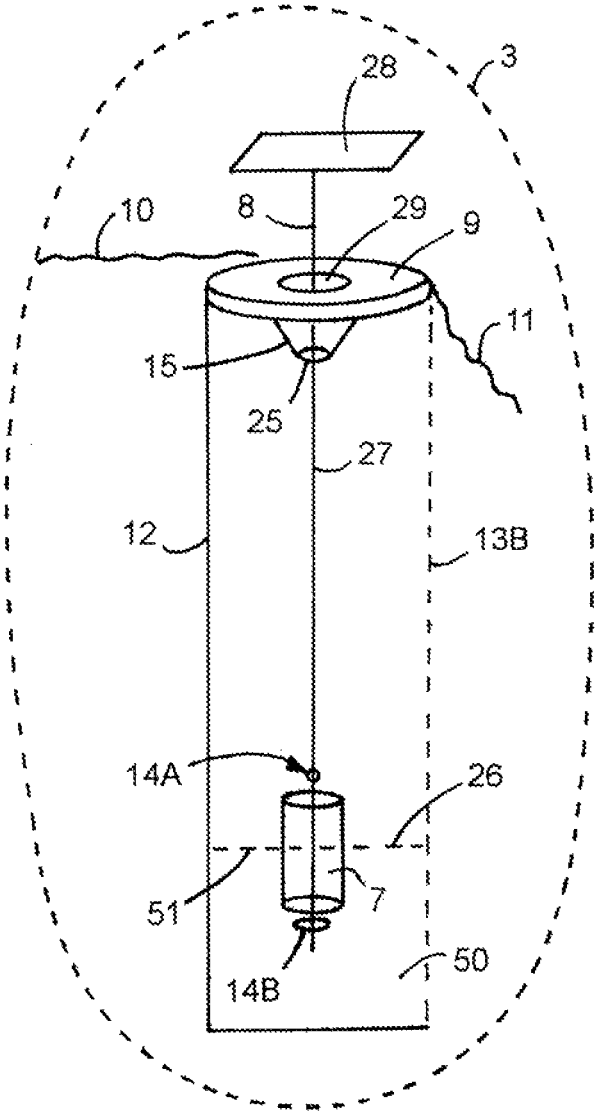
FIG. 4, illustrates an enlarged view of the inventive floatation device, according to one embodiment of this invention.

FIG. 4, illustrates an enlarged view of the inventive floatation device system 3, according to one embodiment of this invention. FIG. 4, shows an enlarged view of the floatation device system 3, with the float 7, at the bottom of the floatation device system 3, held on the plunger rod or shaft 27, of the plunger system 8, by two float stops 14A, 14B, such as, an upper float stop 14A, and a lower float stop 14B. For some applications the float stops 14A, and 14B, could be rubber washers 14A, 14B. The electrically conductive metal washer 9, and the power source wire 11, would complete the electrical connection with the activation wire 10, as discussed elsewhere. Preferably, the cylinder or tube 12, encases the floatation device system 3. The side of the tube 12, is cut along 13B, to allow water 50, access into the tube 12, to raise or lower the float 7, which is mounted to the inside of the stand 2. The electrical activation component 9, has an opening 29, for the passage of the plunger rod or shaft 27. For some applications one could also have at least one plunger stabilizing component 15, having an opening 25, for the passage of the plunger rod or shaft 27. For some applications the plunger stabilizing component 15, could be at least one hard rubber washer 15, that could be used to stabilize the plunger 8, as it move vertically along the tube 12. It should be appreciated that the plunger stabilizing component 15, could be along at any location of the tube 12, as long as it did not interfere with the functioning of any of the components of the plunger system 8, such as, for example, the shaft 27, the float 7, etc.

Figure 5A:
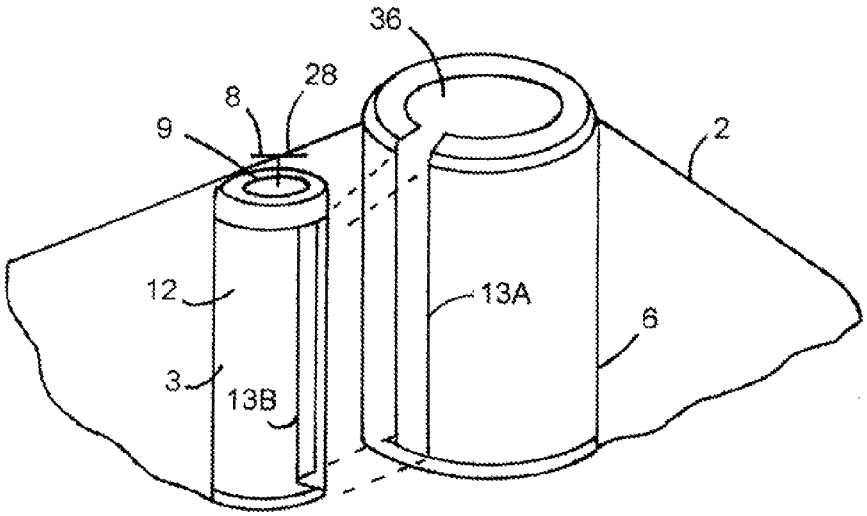
FIG. 5A, illustrates a side perspective view of an inventive tube containing an inventive floatation device system prior to being secured to an inventive water reservoir of the Christmas tree with stand apparatus, according to one embodiment of this invention.

FIG. 5A, illustrates a side perspective view of an inventive tube 12, containing an inventive floatation device system 3, prior to being secured to an inventive water reservoir 6, of the Christmas Tree 1, with stand 2, apparatus, according to one embodiment of this invention. Figure SA, also shows the tube 12, having a slit or cut out 13B, which also contains the floatation device system 3, as being unattached or separate from the water reservoir 6. Similarly, the water reservoir 6, has a cut out or slit 13A, as will be more clear in FIG. 5B.

Figure 5B:
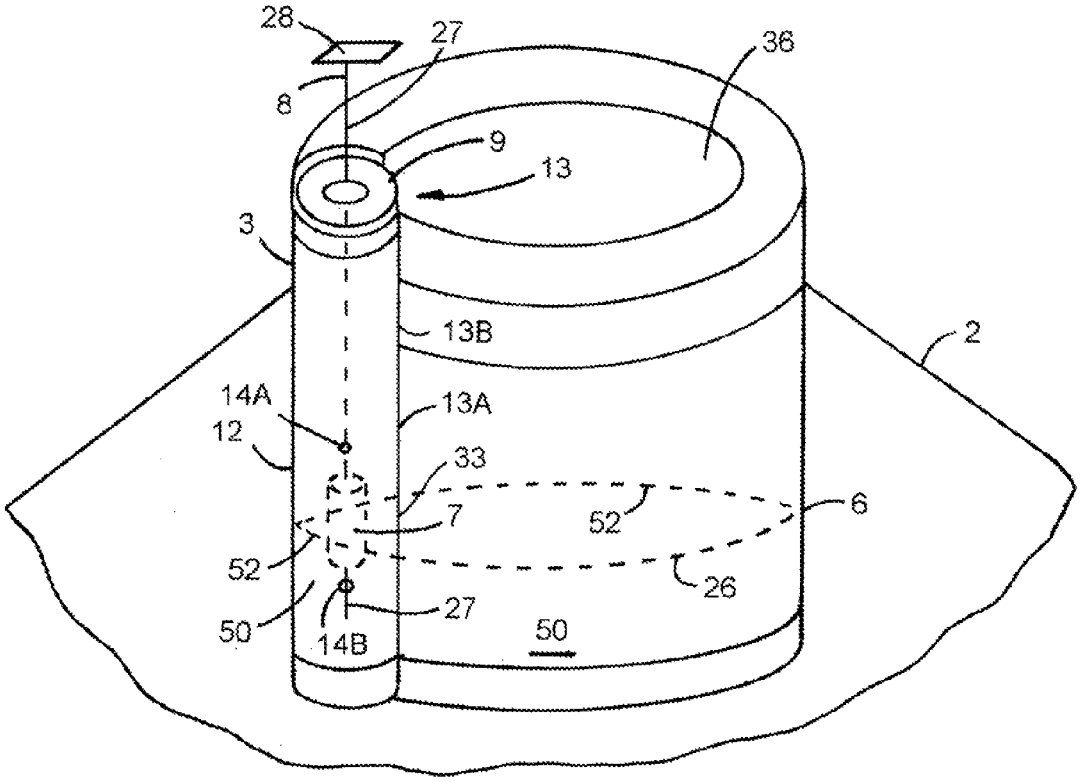
FIG. 5B, illustrates a side perspective view of an inventive tube containing an inventive floatation device system after being secured to an inventive water reservoir of the Christmas tree with stand apparatus, according to one embodiment of this invention.

FIG. 5B, illustrates a side perspective view of an inventive tube 12, containing an inventive floatation device system 3, after being secured to an inventive water reservoir 6, of the Christmas Tree 1, with stand 2, apparatus, according to one embodiment of this invention. As shown in FIG. 5B, the edges of the slit or cutout 13A, of the water reservoir 6, is joined or mated with the edges of the slit or cutout 13B, of the tube 12, and secured thereto, using at least one securing means 33, such as, a water proof epoxy 33, a plastic epoxy 33, to form a water 50, access opening 13, between the tube 12, and the water reservoir 6. The tube 12, containing the floatation device system 3, is now securely mounted and mated with the water reservoir 6, and allows for water 50, access between the water reservoir 6, and the tube 12, via slit or opening 13.

Figure 6A:
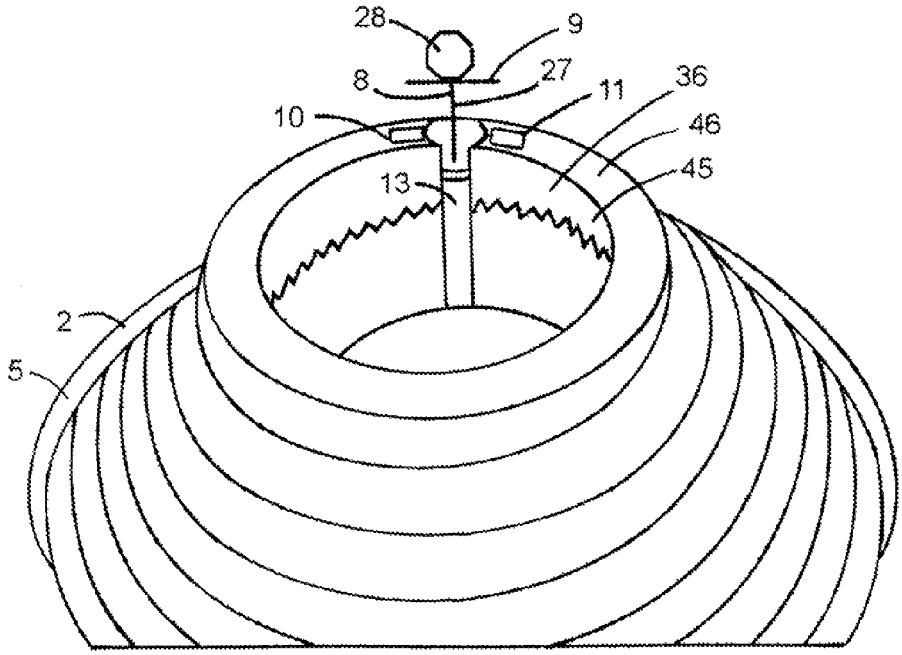
FIG. 6A, illustrates a side perspective view showing a partial inside view of the inventive stand showing an opening for water access to the inventive floatation device for the Christmas tree with inventive stand apparatus, according to one embodiment of this invention.

FIG. 6A, illustrates a side perspective view showing an inside view of the inventive stand 2, showing an opening 36, 45, for water 50, access to the inventive floatation device 3, for the Christmas Tree 1, with inventive stand 2, apparatus 23, according to one embodiment of this invention. FIG. 6A, shows a float device plunger 8, that has been elevated by water through cut-out 13, within the stand 2. In this embodiment the wiring 10, 11, is on the upper or top surface of the stand 2, around the stand mouth 46, such that the activation wire or tab 10, and the power source wire or tab 11, are electrically activated when the electrically conductive metallic activation disc or tab 28, moves down and makes an electrical connection between the activation wire or tab 10, and the power source wire or tab 11, to activate the alarm or buzzer 17. For some applications, the electrical activation disc or tab 28, could also be the electrical contact 9, as more clearly shown in FIG. 6A, that creates the electrical circuit or connection between the activation wire or tab 10, and the power source wire or tab 11, to activate the alarm 17.

Figure 6B:
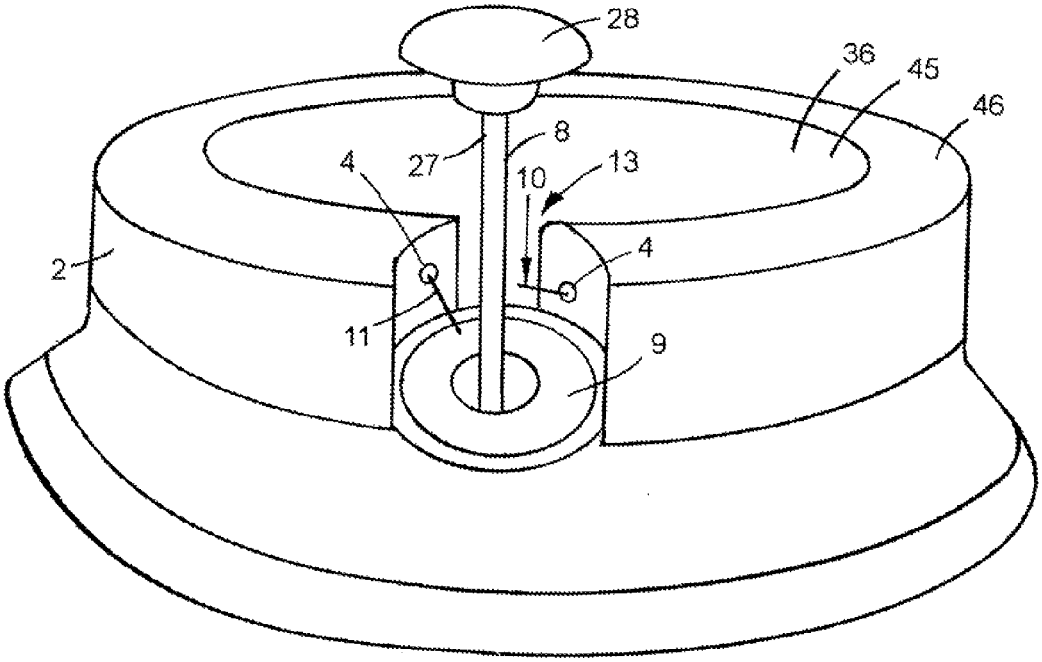
FIG. 6B, illustrates a side perspective close up view of the wiring, and the inventive floatation device set into the top of the stand for the Christmas tree with inventive stand apparatus, according to one embodiment of this invention.

FIG. 6B, illustrates a side perspective close up view of the wiring 10, 11, and the inventive floatation device system 3, that is set into the stand 2, for the Christmas Tree 1, with inventive stand 2, apparatus 23, according to one embodiment of this invention. FIG. 6B, is a close-up view of plunger 8, mounted into the stand 2, with access hole or opening 4, for the wiring 10, 11, where one of the activation wire 10, or the power source wire 11, is attached to the electrically conductive metallic washer 9. Thus, when the plunger 8, moves down due to the evaporation or consumption of water 50, by the Christmas tree 1, the activation disc or tab 28, pushes the non-connected wire 10, 11, to come in contact with the electrically conductive disc or washer 9, and thus complete the electrical circuit to activate the alarm or buzzer 17.

Figure 7:
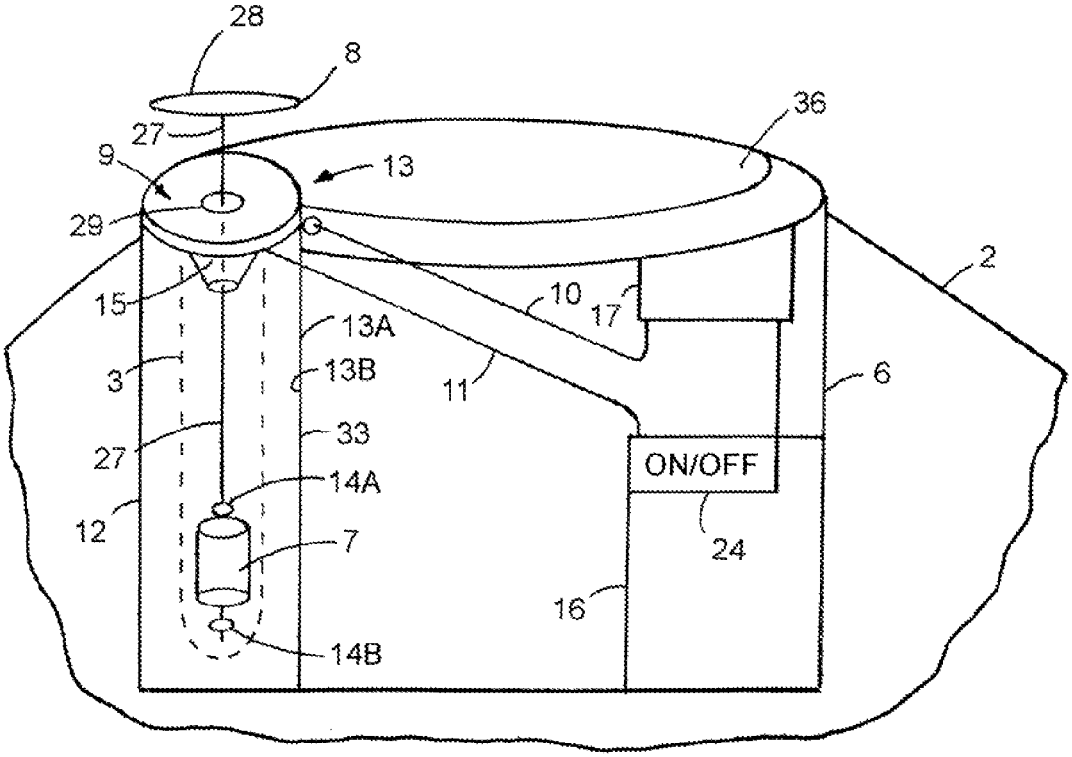
FIG. 7, illustrates a side perspective view of the inventive floatation device, along with a wiring diagram for the activation of a low water condition for the Christmas tree with an inventive stand apparatus, according to one embodiment of this invention.

FIG. 7, illustrates a side perspective view of the inventive floatation device system 3, along with a wiring diagram for the activation of a low water 51, condition for the Christmas Tree 1, with inventive stand 2, apparatus 23, according to one embodiment of this invention. FIG. 7, further shows the tube 12, which contains the floatation device system 3, mounted inside the stand 2, and connected to the water reservoir 6. Also, shown is the battery pack 16, which could contain a power source 16, such as, for example, double A batteries 16, triple A batteries 16, 9 volt batteries 16, an AC/DC power source 16, to name a few, which is triggered when the activation disc 28, of the plunger system 8, makes contact with the activation wire 10, which in turn contacts the electrically conductive metallic washer 9, to the power source wire 11, which completes the circuit and activates the alarm or buzzer 17.

FIG. 8A, illustrates a perspective view of an inventive tree stand spring compression stabilization system 18, according to one embodiment of this invention. FIG. 8A, shows the tree stand spring compression stabilization system 18, which comprises of a metal band 19, having an opening 38, and having a plurality of spring steel components 21, 22, secured to the inside peripheral wall of the metal band 19, such as, via one securing means 41, such as, a weld 41. For some applications the metal band 19, could be attached or secured to the stand 2, via securing means 30, such as, screws 30, using, for example, mounting holes 20. For some application the Christmas tree trunk 31, is secured and held in place via spring steel 21, 22, such as, for example, four 5"long, ¾" wide spring steel 22, and four 4" long, ¾" wide spring steel 21.

FIG. 8B, illustrates a perspective view of an inventive tree stand spring compression stabilization system 18, showing a tree trunk 31, that is pushed through the spring steel components 21, 22, through the opening 38, and is placed in an erect and stabilized mode, according to one embodiment of this invention. It should be understood that the securing means 30, are used to secure the metal band 19, to the inner peripheral wall of the stand 2. The securing means 30, can be used to secure the outside wall of the stand 2, to the inside wall of the metal band 19, or the inside wall of the metal band 19, can be secured to the inside wall of the stand 2. However, for some applications the metal band 19, could be a part of the neck of the stand 2, as the integration of the metal band 19, into the stand 2, would be caused by the integrated securing means 30, such as, a weld 30, a channel 30, etc., as shown in FIG. 1.

It should be appreciated that water 50, when replenished reaches a water level 26, which could be the first water level threshold 51, and then as the water 50, is consumed by the tree 1, or evaporates, the water level 26, then reaches a second water level threshold 52. Thus, the first water level threshold 51, is when the alarm 17, automatically deactivates, as the float 7, rises with the water level 26, and moves the electrical activation disc or tab 28, away from the electrical contacts 9, 10, and 11. Similarly, when the second water level threshold 52, is reached, the alarm 17, automatically gets activated to indicate that the water 50, needs to be replenished for the inventive apparatus 23, as the electrical activation disc or tab 28, creates the electrical connection between the electrical contact 9, activation wire or tab 10, and the power source wire or tab 11, due to the lowering of the float 7, within the water 50.

The low water 51, indicator can be a buzzer 17, an alarm 17, a light 17, an LED type of light 17, or any other indicating means 17, that will visually 17, or by sound 17, provide an indication to a user that water level 26, is either low or is needed in the tree/plant stand 2.

It should be appreciated that liquid level floats 7, also known as float balls 7, are typically spherical, cylindrical, oblong or similarly shaped objects, made from either rigid or flexible material, that are buoyant in water 50, and other liquids 50. These are non-electrical hardware 7, and frequently used as visual level measurement. Here the float 7, has been incorporated into a switch mechanisms in a fluid tube 12, as a component in monitoring liquid level. It is well known that liquid level floats, or float switches, use the principle of material buoyancy (differential densities) to follow fluid levels, thus the float 7, would move up or down with the up or down movement of the liquid level 26. Solid floats 7, are often made of plastics with a density less than water 50, or other application liquid 50, and so they float. Hollow floats 7, filled with air are much less dense than water 50, or other liquids 50, and are appropriate for some applications.

KEY

1 Christmas Tree
2 Stand
3 Floatation device system
4 Holes for wire access
5 Over fill channel
6 Water reservoir
7 Float
8 Plunger
9 Metal washer
10 Activation wire
11 Power source wire
12 Tube or float cylinder
13A Slit or cut-out in water reservoir
13B Slit or cut-out in tube
13 Slit or cut-out for water access between water reservoir and tube
14A Upper float stop
14B Lower float stop
15 Hard rubber washer
16 Battery pack
17 Buzzer or alarm
18 Tree stand spring compression stabilization system
19 Metal band
20 Four mounting holes
21 5"=length spring steel (maximum extension)
22 6" length spring steel (maximum extension)
23 Inventive Christmas Tree stand
24 ON/OFF switch
25 Opening in hard rubber washer
26 Water level
27 Plunger rod or shaft
28 Electrical activation disc or tab
29 Opening in metal washer
30 Securing means
31 Christmas Tree trunk
32 Christmas Tree branches
33 Epoxy or adhesive
36 Water reservoir mouth or neck
38 Opening in stand
41 Weld
42 Stand base or bottom
45 Stand opening
46 Stand mouth or top
50 Water or liquid
51 First threshold of water or liquid level
52 Second threshold of water or liquid level.

The Christmas tree stand 2, that was experimented with had a 7 inch diameter opening 45, and was about 7 inches deep, from the stand base 42, to the stand mouth 46. A plastic tube 12, about 5½ inches long, and having an opening of about 1 inch, was inserted into the Christmas tree stand 2, along with a thermometer, such as, a cooking thermometer, which was electrically connected to a buzzer 17. A Styrofoam 7, was used as a float 7. A triple A Battery Pack 16, with an ON/OFF switch 24, was used to provide the electrical power, however, one can also use an A/C current 16, or an A/C current with a DC adaptor 16, to provide the needed electrical circuit to the inventive Christmas tree stand 2, for the visual or sound activation of the alarm 17.

The cross-sectional area for the inventive activation disc or tab 28, can be selected from a group comprising a triangle, a square, a rectangle, a circle, an oval, a polygonal shape, a cylindrical shape, and combinations thereof, to name a few.

The cross-sectional area for the float 7, can be selected from a group comprising a triangle, a square, a rectangle, a circle, an oval, a polygonal shape, a cylindrical shape, and combinations thereof, to name a few.

The stand 2, can be made using at least one material selected from a group comprising a metallic material, a plastic material, a polymeric material, a composite material, and combinations thereof, to name a few.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A tree stand comprising:

(a) a stand having a base and a neck, said neck having at least one opening for passage of a trunk of a tree;

(b) at least one water reservoir having a slit and contained within said stand, and wherein said water reservoir is between said base and said neck of said stand;

(c) at least one tube having a slit, and wherein said slit of said at least one tube is mated and secured to said slit of said at least one water reservoir using at least one securing means, such that said at least one tube is secured and interconnected with said water reservoir, and wherein said at least one tube has a plunger which move vertically within said at least one tube, and wherein water freely moves between said at least one tube and said at least one water reservoir;

(d) said plunger having a shaft, and wherein an activation disc is secured to an upper end of said shaft, and at least one float is secured to a lower end of said shaft, and wherein said float is in physical contact with said water in said tube, and wherein said plunger moves vertically within said at least one tube as a result of water movement within said at least one water reservoir and said at least one tube; and (e) wherein said stand has at least one electrical bridge, at least one activation contact, at least one power source contact, and at least one power source therein, and wherein said activation disc activates an alarm when said water level is below a first threshold, and wherein said alarm is activated when said activation disc comes in contact with said at least one electrical bridge, said at least one activation contact, and said at least one power source contact.

2. The tree stand recited in claim 1, wherein said alarm is automatically deactivated when water is replenished inside said water reservoir to a second threshold.

3. The tree stand recited in claim 1, wherein said at least one electrical bridge is selected from a group consisting of an electrically conductive washer, and an electrically conductive metallic element, and combinations thereof.

4. The tree stand recited in claim 1, wherein said float is selected from a group consisting of a cylindrical float, a square float, a ball shaped float, and combinations thereof.

5. The tree stand recited in claim 1, wherein the cross-sectional area for said activation disc is selected from a group consisting of a triangular shape, a square shape, a rectangular shape, a circular shape, an oval shape, a polygonal shape, a cylindrical shape, and combinations thereof.

6. The tree stand recited in claim 1, wherein the cross-sectional area for said float is selected from a group consisting of a triangular shape, a square shape, a rectangular shape, a circular shape, an oval shape, a polygonal shape, a cylindrical shape, and combinations thereof.

7. The tree stand recited in claim 1, wherein said stand is made from at least one material selected from a group consisting of a metallic material, a plastic material, a polymeric material, a composite material, and combinations thereof.

8. The tree stand recited in claim 1, wherein said at least one power source is selected from a group consisting of AA battery, AAA battery, a 9 volt battery, a button cell battery, an AC/DC power source, and combinations thereof.

9. The tree stand recited in claim 1, wherein said stand has at least one opening for the passage of one of said at least one activation contact, and said at least one power source contact.

10. The tree stand recited in claim 1, wherein edges of said slit of said at least one tube is secured to corresponding edges of said slit of said water reservoir using said at least one securing means, and wherein said at least one securing means is selected from a group consisting of a water proof epoxy, and a plastic epoxy.

11. The tree stand recited in claim 1, wherein said at least one float is engageably held on said shaft using at least one upper float stop, and at least one lower float stop.

12. The tree stand recited in claim 1, wherein said tube has at least one plunger stabilizing component.

13. The tree stand recited in claim 1, wherein said stand has at least one overfill channel.

14. The tree stand recited in claim 1, wherein said stand has at least one low water indicator.

15. The tree stand recited in claim 1, wherein said stand has at least one low water indicator, and wherein said at least one low water indicator is said alarm.

16. The tree stand recited in claim 1, wherein said stand has at least one low water indicator, and wherein said at least one low water indicator is said alarm, and wherein said alarm is selected from a group consisting of a buzzer, an LED light, a light, a sound indicator, and combinations thereof.

17. The tree stand recited in claim 1, wherein at least one tree stand spring compression stabilization system is contained within said stand.

18. The tree stand recited in claim 1, wherein at least one tree stand spring compression stabilization system is contained within said stand, and wherein said at least one tree stand spring compression stabilization system comprises of a metallic band, and a plurality of spring steel, and wherein an upper end of said spring steel is secured to said peripheral wall of said metallic band.

19. The tree stand recited in claim 1, wherein at least one tree stand spring compression stabilization system is contained within said stand, and wherein said at least one tree stand spring compression stabilization system comprises of a metallic band, and a plurality of spring steel, and wherein an upper end of said spring steel is secured to said peripheral wall of said metallic band, and wherein the outer peripheral wall of said metallic band is secured to the inside peripheral wall of said stand.

20. A tree stand comprising:

(a) a stand having a base and a neck, said neck having at least one opening for passage of a trunk of a tree;

(b) at least one water reservoir having a slit and contained within said stand, and wherein said water reservoir is between said base and said neck of said stand;

(c) at least one tube having a slit, and wherein said slit of said at least one tube is mated and secured to said slit of said at least one water reservoir using at least one securing means, such that said at least one tube is secured and interconnected with said water reservoir, and wherein said at least one tube has a plunger which move vertically within said at least one tube, and wherein water freely moves between said at least one tube and said at least one water reservoir;

(d) said plunger having a shaft, and wherein an activation disc is secured to an upper end of said shaft, and at least one float is secured to a lower end of said shaft, and wherein said float is in physical contact with said water in said tube, and wherein said plunger moves vertically within said at least one tube as a result of water movement within said at least one water reservoir and said at least one tube;

(e) wherein said stand has at least one electrical bridge, at least one activation contact, at least one power source contact, and at least one power source therein, and wherein said activation disc activates an alarm when said water level is below a first threshold, and wherein said alarm is activated when said activation disc comes in contact with said at least one electrical bridge, said at least one activation contact, and said at least one power source contact; and (f) at least one tree stand spring compression stabilization system contained within said stand, and wherein said at least one tree stand spring compression stabilization system comprises of a metallic band, and a plurality of spring steel, and wherein an upper end of said spring steel is secured to said peripheral wall of said metallic band, and wherein the outer peripheral wall of said metallic band is secured to the inside peripheral wall of said neck of said stand.

* * * * *